US005967662A

United States Patent [19]

Chew

[11] Patent Number: 5,967,662

[45] Date of Patent: Oct. 19, 1999

[54] INSTANT PULL T-SHIRT BAG STACK AND METHOD OF MANUFACTURING SAME

[75] Inventor: Yook-Meng Chew, Port Lavaca, Tex.

[73] Assignee: Inteplast Group, Ltd., Livingston, N.J.

[21] Appl. No.: 09/050,708

[22] Filed: Mar. 30, 1998

[51] Int. Cl.[6] ..... B65D 33/10

[52] U.S. Cl. ..... 383/8; 383/9; 383/37; 206/554

[58] Field of Search ..... 383/8, 9, 37; 206/554

[56] References Cited

U.S. PATENT DOCUMENTS

| | | | |
|---|---|---|---|
| 4,989,732 | 2/1991 | Smith | 206/554 |
| 5,183,158 | 2/1993 | Boyd et al. | 206/554 |
| 5,269,605 | 12/1993 | Nguyen | 206/554 X |
| 5,335,788 | 8/1994 | Beasley et al. | 206/554 |
| 5,465,846 | 11/1995 | Blyth et al. | 206/554 |
| 5,484,376 | 1/1996 | Prader et al. | 206/504 X |
| 5,507,713 | 4/1996 | God, Sr. et al. | 206/554 X |
| 5,609,930 | 3/1997 | Matsunaga et al. | 206/554 X |
| 5,670,013 | 9/1997 | Huang et al. | 206/554 X |
| 5,695,064 | 12/1997 | Huang et al. | 206/554 |
| 5,799,793 | 9/1998 | Glod, Sr. et al. | 206/554 |
| 5,845,779 | 12/1998 | Wilfong, Jr. et al. | 206/554 |
| 5,881,885 | 3/1999 | Fletcher et al. | 206/554 |

*Primary Examiner*—Jes F. Pascua
*Attorney, Agent, or Firm*—Beehler & Pavitt; William H. Pavitt, Jr.; David A. Belasco

[57] ABSTRACT

A stack of plastic T-shirt bags and method of making the same wherein the bags of the stack have been subjected to two corona treatments to increase the adhesion between the back wall of each bag and the front wall of the next ensuing bag with a row of pressure points being provided at the base of the central mounting tab in order to enable each bag as it is pulled open on the rack arms to initiate opening of the next ensuing bag. The mounting tab is cut to provide not only a central mounting slit, but also with a wave-like cut below the mounting slit to enable the mounting tab to be torn for removal from the central mounting element without the tear extending down into the bag walls.

5 Claims, 3 Drawing Sheets

10
12
14
16
18a
18b
20
20'
22
22a
24
24a
25
26
44
56
57
58
58
60a
60b
62
66
68
70
72
74
76
78a
78b
80a
80b

INSTANT PULL T-SHIRT BAG STACK AND METHOD OF MANUFACTURING SAME

FIELD OF THE INVENTION

This invention relates generally to the field of plastic shopping bags, and particularly to those of the T-shirt type which are provided to stores in packs which, when mounted on a conventional two arm rack, are self opening as each preceding bag of the pack is pulled off the rack.

BACKGROUND OF THE INVENTION

During the past dozen years, plastic shopping bags, and particularly those of what are called the T-shirt type, have largely replaced paper bags in grocery stores and supermarkets. The number of T-shirt bags which are sold annually in the United States alone approaches 100 billion.

Many varieties of T-shirt bags have been devised by various inventors and, almost from the outset, efforts have been made to provide bag packs which, when mounted on a conventional twin arm rack, have the back wall of each bag of the pack detachably adhered to the front wall of the immediate following bag. The purpose of this detachable adhesion is to cause the back wall of the preceding bag, after it is filled and it is being drawn off the rack by its mounting handles, in effect, to pull the front wall of the next succeeding bag forward from its back wall and thereby open the mouth of the bag while the bag arms are still hung on the rack so the thus opened bag may be filled with purchased items by the store sales clerk or box boy.

Initially, the desired adhesion has been suggested to be accomplished by providing some adhesive spot or limited adhesive area between the back wall of each lead bag and the front wall of the next ensuing bag. Examples of such detachable adhesive bondings may be found in U.S. Pat. Nos. 4,676,378; 5,020,750; 5,307,935; 5,333,730; 5,469,970; and 5,561,967.

A second method for producing the desired detachable adhesion between the rear wall of one bag and the front wall of the next ensuing bag has been by applying pressure forces on selected spots or limited areas of the bag pack when the pack of blanks is subjected to the cutting die. An example of such method of providing the desired detachable adhesion may be seen in U.S. Pat. No. 5.465,846, and is suggested in U.S. Pat. No. 5,183,158. The pressure point expedient, however, may also be utilized in conjunction with either adhesive, or with the third method of providing adhesion, namely, corona treatment. Examples of the latter combination may be found in U.S. Pat. Nos. 5,335,788; 5,562,580; 5,507,713; and 5,125,604.

As explained in U.S. Pat. No. 5,335,788, while corona treatment may provide suitable adhesion between bags made of low density polyethylene (LDPE) or linear low density polyethylene (LLDPE), as disclosed in U.S. Pat. No. 5,087,234, sufficient adhesion has not been found to occur where high molecular weight high density polyethylene (HDPE) is utilized in the manufacture of the bag. It is for this reason that the inventors of U.S. Pat. No. 5,335,788 have additionally provided in that patent for pressure points or at least one localized compressed area in combination with corona treatment of HDPE bags. These last mentioned inventors have stated in their patent that there was insufficient adhesion for HDPE bags where the bags, during formation, had been subjected only to a single corona exposure and the pressure of the die as it came down on packs of blanks to cut out the bag mouths. It has been found necessary, therefore, in prior corona treated bags to supplement whatever adhesion may occur during bag cutting, with special pressure points accomplished by incorporating some type of staking element or elements in the blank cutting die.

Effecting detachable adhesion by applying adhesive to the bag walls has always presented problems in bag manufacture as, for example, the adhesive must be of a particular consistency and state and applied accurately to limited areas and, after it has been applied, the bag pack must be maintained at temperatures and other conditions which will not cause the adhesive to harden or to become too soft. Either of these results could present problems in securing the desired opening of the bags of the bag pack. Other disadvantages in use of adhesive bags are aptly described in column 2 of U.S. Pat. No. 5,465,846.

As to relying upon instruments to effect pressure adhesion at a selected point or points in the bags of the bag pack, this requires modification of the normal cutting die and, unless carefully placed and properly calculated for the quantum of pressure applied, can result in so weakening of the bags at such pressure points that the bags may tear at or about such pressure points when filled with groceries or purchased articles at the store and separation of the adhered walls is effected by pulling the leading bag from the rack arms.

It may be seen, therefore, that a need still exists for providing bag packs having a consistent type of detachable adhesion between the rear and front walls of consecutive bags with pressure points of minimum impact on the bag packs to avoid weakening walls of the bags in the pack with the resulting tearing of bags about such pressure points.

SUMMARY OF THE INVENTION

The present invention satisfies the need thus pointed out in the preceding paragraph in part by exposing the bags as they are formed to two separate corona treatments at different stages of the bag formation process in order to improve the adhesion between adjacent bag walls through the blocking process and/or by pressure points in the stacked bags.

While the present invention is particularly effective for bags of HDPE, it may also be employed to improve adhesion between the walls of bags made of LLDPE or LDPE. The usual type of formulation using these resins is modified by incorporating fillers such as talc, calcium carbonate, mica and the like in an amount of between 5 and 25% of the total weight of the entire mixture. The latter could also include additives such as pigments and anti-statics. The filler and additives improve the adhesion of adjacent walls when they are pressed together.

Further, a plurality of closely spaced compression members in series are applied either longitudinally across the base of each central tab, or vertically in each of the bag handles, preferably below the mounting orifices; or both such horizontal and vertical series of pressure points may be effected. With such multiple pressure areas so disposed, no one point of the bag walls is stressed to where undesired tearing may be the result. Thereby, the percentage of successful consecutive openings of ensuing bags will be found to have been greatly augmented.

Lastly, to further diminish the stress on the bag walls at each of the pressure points, the pin or stake by which each pressure point is made, is preferably rounded at its impacting end, thereby to produce a domed impression on each of the walls of the bags of the pack.

Each of these improvements may be employed either simply or in combination with one or more of the others to improve bag wall adhesion, but when all four are utilized, the percentage of successful bag openings will be found to approach 100.

BRIEF DESCRIPTION OF THE DRAWINGS

In the accompanying drawings.

DESCRIPTION OF THE PREFERRED EMBODIMENTS

Figures 1A, 1E:
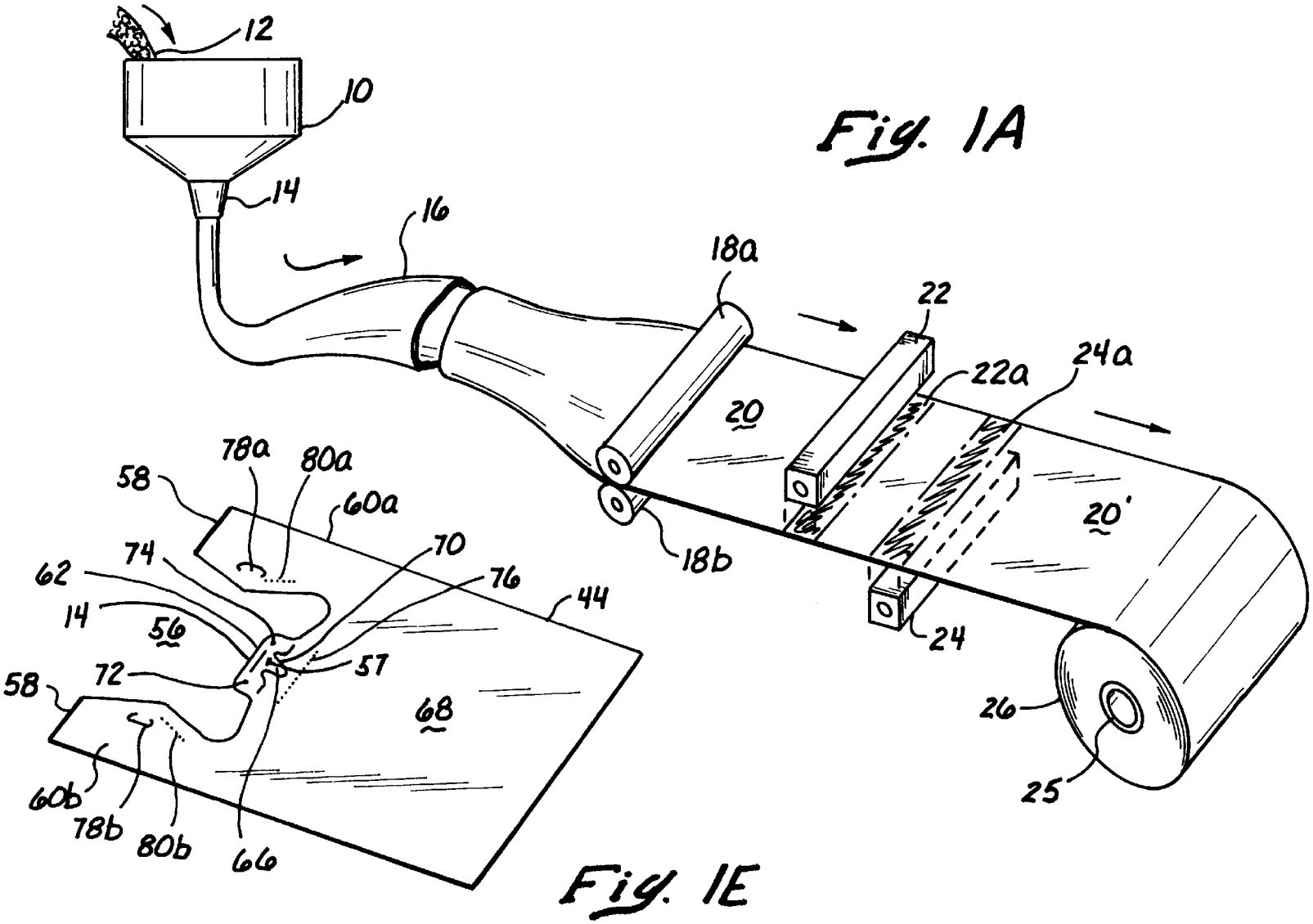
FIG. 1A is a schematic representation of the initial steps of the bag making process.
FIG. 1E is a perspective view of a bag produced in accordance with the four steps illustrated in FIGS. 1A, 1B, 1C and 1D.

What is shown schematically in FIGS. 1A, 1B, 1C and 1D are the steps employed in a conventional T-shirt plastic bag manufacturing method, but with several important modifications which comprise the present invention. As shown in FIG. 1A, a hopper 10 is provided to receive a mixture of resins, fillers and additives. The resins could be of the types of HDPE, LLDPE or LDPE and the filler, such as talc, calcium carbonate or mica is provided at between 5% and 25% by weight of the entire mixture. The resin and filler are heated to a fluid state in the extruder 10*a* and extruded through the nozzle 14, to form a tube 16 which is moved between the rollers 18*a* and 18*b* to be flattened as shown at 20. The thus-flattened tube 20 is passed between the upper and lower electrodes 22 and 24, respectively, for a first corona exposure. As the flattened tube 20 passes below the electrode 22, it passes over a dielectric roll or other surface 22*a*, disposed directly below the electrode 22. Further, as the flattened tube 20 passes over the electrode 24, it passes under a similar dielectic roll or surface 24*a*. This is a conventional manner of effecting corona treatment, as illustrated and described in U.S. Pat. No. 5,335,788 and is employed to enhance receptivity of printing on the film.

The thus-corona treated film 20' may be rolled up about a core 25 to form a roll 26. Such a roll-up is necessary when the rate of extrusion of the tube 20 is greater than the speed of the actual bag making process of a machine hereinafter to be described. Where the rate of extrusion is no greater than the processing capability of such bag making machine, the flattened corona treated tube 20' may be passed directly into the bag making machine without being first wound up to form a roll 26 as shown in FIG. 1A, and then unwound for further processing as hereinafter described. However, in the process illustrated in FIGS. 1A and 1B and hereinafter described, the flattened corona treated tube 20' is wound up to form the roll 26.

Figure 1B:
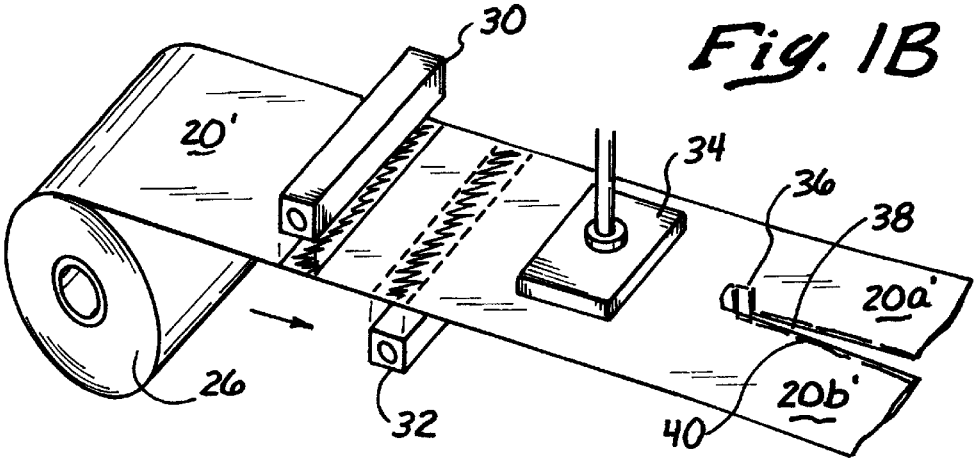
FIG. 1B is a schematic representation of a portion of the process involving a second corona treatment, printing and slicing and heat sealing the divided tube which follows the initial steps represented in FIG. 1A.

As shown next in FIG. 1B, the roll 26 may be moved to a bag fabricating machine where the film 20' is unrolled and passed under and over a second pair of corona treating electrodes 30, 32, following which the tube may be first subjected to printing by the printer 34.

Immediately following the printing step last described, the tube 20' may be moved over a hot knife 36, which both slices the moving tube 20' into two halves 20*a*', 20*b*' (or any other desired portion—depending upon the size of the bags to be produced) and simultaneously heat seals the parting edges 38, 40. The thus divided and edge sealed tubes 20*a*' and 20*b*' are thereafter removed separately through the machine (not shown) with each bag similarly further processed. In this specification and the drawings, the further processing of only one 20*a*' of the two divided tubes 20*a*' and 20*b*' will be described, it being understood that the other divided tube 20*b*' will simultaneously be processed in the same manner as 20*a*' in another part of the bag making machine (not shown).

Figure 1C:
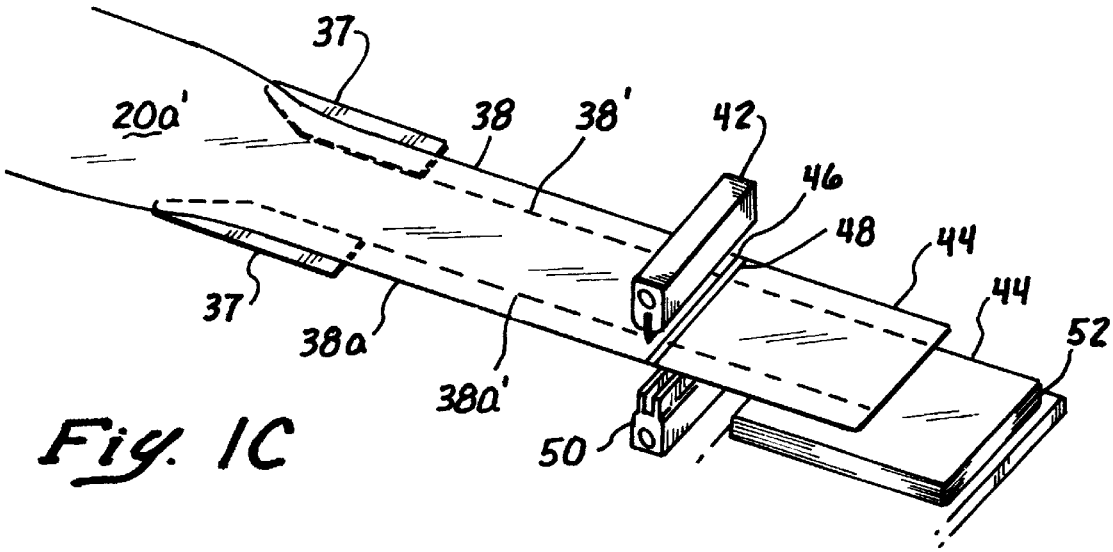
FIG. 1C illustrates the gusseting, cutting and sealing and stacking steps which follow each half of the divided tubing as shown in FIG. 1B.

As shown in FIG. 1C, the tubing 20*a*' is next passed into gusseting apparatus 37 whereby the edges 38, 38*a* of the flattened tubing 20*a*' are formed with gussets 38' and 38*a*', respectively.

The next step in the method is for a cutter 42 to be moved down onto the gusseted flattened tubing 20*a*' at predetermined intervals to sever the tubing 20*a*' transversely into desired length blanks 44, while simultaneously the severed edges 46, 48 are heat-sealed by the element 50. A predetermined number of blanks 44 are disposed one in sequence upon each previous blank to form a stack 52 of blanks 44.

Figure 1D:
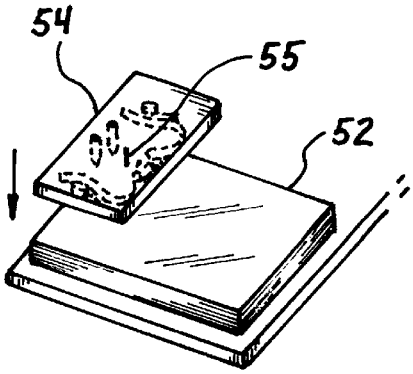
FIG. 1D illustrates the final die cutting stage of the process.
Figure 2:
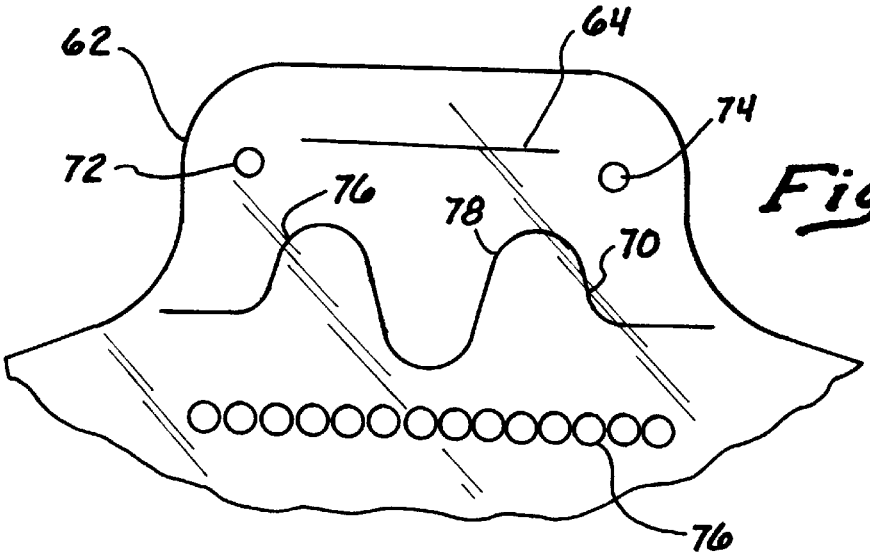
FIG. 2 is an enlarged plan view of the central mounting tab of the bag shown in FIG. 1E.

The final step is illustrated in FIG. 1D. In this final step, a die 54 is impacted forcefully on the stack 52 to cut each bag of the stack 52 to the configuration shown in FIG. 1E, while simultaneously a hot pin 55 is brought down and pressed through, and withdrawn from, the area 57 which becomes, upon completion of the die cutting, the center tabs 62 of the bags 59 formed from the stack of blanks 52. From FIG. 1E, it may be seen that the bag blank 44 has been cut to provide a mouth 56, extending down from the upper blank edge 58 to leave a pair of handles 60*a* and 60*b*, and central tab 62, having a slit orifice 64 and a base 66 extending upwardly from the upper central portions of bag walls 68, but with an interceding perforated, or weakened wave-like line 70. Each of the tabs 62 also has two spaced apart indentations or pressure points 72, 74. In addition, below the wave-like line 70, there have also been provided a horizontal line of further indentations or pressure points 76.

Each handle 60*a*, 60*b* has also been cut at 78*a*, 78*b*, respectively, to provide openings for mounting the bag by its handles 60*a*, 60*b* on rack arms 84 (FIG. 3), as hereinafter explained. Lastly, adjacent but below each cut 78*a*, 78*b* may be provided a linear series of indentations or pressure points 80*a*, 80*b*.

Figure 4:
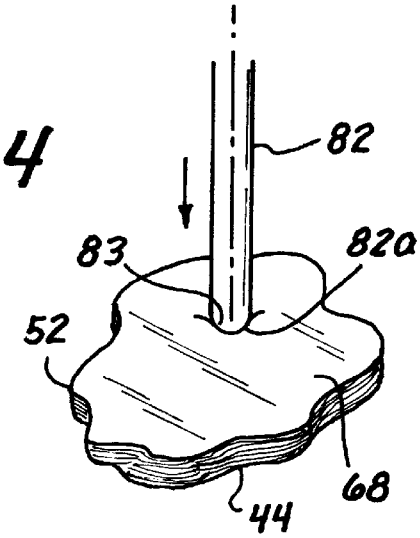
FIG. 4 is an enlarged partial view of a die striking a stack of bags.

It is also a feature of the present invention that, in addition to providing a linear series of pressure points 76 below the severance line 70 of the tab 62, and pressure points 80*a*, 80*b* below the handle orifices 78*a*, 78*b*, respectively, each impacting die 82, in order to effect such pressure points as shown in FIG. 4, may be rounded at its contacting end 82*a* so as to produce inversely domed impressions 83 in the walls 68 of the blank 44 of the stack 52. The combination of the linear series of the thus domed pressure points 76 will be found to substantially decrease the stress in the areas where the dies 82 are impacted on the bag stack 52.

Figure 3:
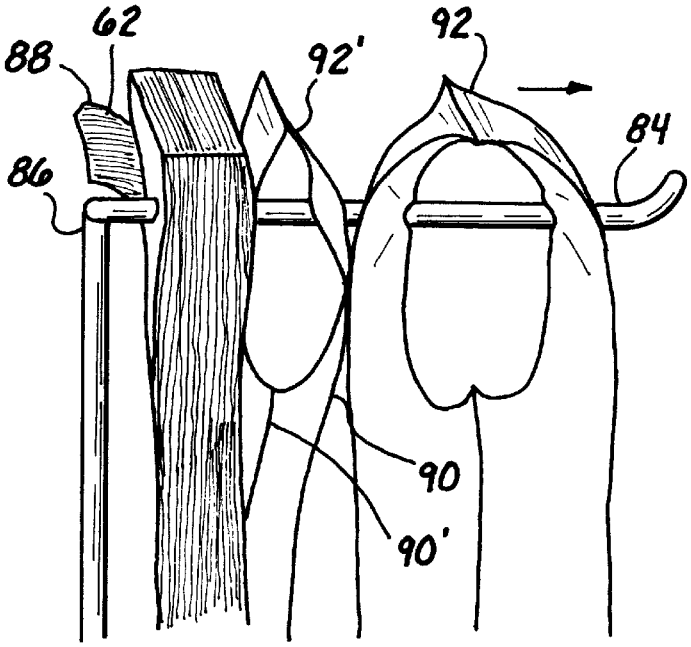
FIG. 3 is a side view of a stack of bags mounted on a rack with the first bag in the process of being removed from the rack.

The effect of the present invention will be to maintain the orifices 78*a* and 78*b* of the handles 60*a* and 60*b*, respectively, as well as to maintain the tab orifices 64 in register, thereby enabling the handle orifices 78*a*, 78*b* to be slipped on the projecting arms 84 of a rack 86 and the tab orifices 64 on retaining element 88 partially shown in FIG. 3 without the need for welded flaps, as shown in Patent RE 33,264, in the case of the handles 60*a*, 60*b*. In addition, the combination of double corona treatment and pressure points 76 at the base 66 of the tabs 62 and pressure points 72 and 74, not only enables the tabs 62 to be maintained in better register for placement on the rack mounting element 88, but will cause the front wall 90 of the next bag 92' better to be drawn apart from its rear wall 90' to open the bag 92' for filling, as the front bag 92 is pulled off the rack arm 84, as best shown in FIG. 3. The sinusoidal severance line 70 improves the holding of the tab 62 on the retainer element 88 when the slit 64 is forced over the retainer element 88, but will nevertheless part when its bag 92 is pulled to remove it from the rack 86.

While the bag making process has been illustrated herein in a series of separate steps, it will be readily appreciated by those skilled in the art that a machine may be devised to accomplish all the described and illustrated steps in a continuous sequence—even to the point where it is un-necessary first to roll up the tubing as shown in FIG. 1A, and then unroll it as shown in FIG. 1B. In addition, as each bag stack 52 is piled up, as shown in FIG. 1C, when a predetermined number of bags have been accumulated, the stack may be moved automatically into the die cutting, hot pin and pressure point developing position (FIG. 1D); and after the die has been brought down upon the stack and withdrawn, the stack may be ejected into a packing and removal station (not shown). Since such final steps form no part of the present invention and are well known in the art, they are not illustrated nor described herein.

I claim:

1. A stack of self-opening plastic T-shirt bags for mounting on a rack having a pair of forwardly projecting parallel arms spaced from each other and a centrally disposed upwardly extending mounting element intermediate the arms, each bag of the stack comprising:

(a) forward and rear walls formed by extruding a compound comprising a resin selected from the group consisting of HDPE, LLDPE or LDPE with a filler selected from the group consisting of talc, calcium carbonate or mica of between 5% and 25% of the total weight of the compound, said walls being secured together at their top and bottom edges and for a first predetermined distance along the side edges upwardly from the bottom edges of the walls; the outsides of the walls of the bag having been corona treated to augment adhesion between adjacent outside walls of bags of the pack, (b) a bag mouth centrally disposed and extending downwardly a second predetermined distance from the top edges of the walls and inwardly of the side edges to provide a pair of opposed handles spaced from each other, a portion of the bag walls defining lower edges of the bag mouth, further including a centrally disposed slotted tab for placement on the mounting element of the rack, said tab having a pair of oppositely spaced apart pressure points further spaced from the tab orifice;

(c) each of the handles being orificed to enable the handle to be mounted on one of the forwardly projecting rack arms; each handle of the bag having been impacted to provide at least two vertically aligned closely adjacent pressure points disposed commencing below and spaced from the handle orifice and extending downwardly toward a base of the handle; and (d) the area of the bag walls below the centrally disposed slotted tab being impacted to provide at least one pressure point.

2. The stack of plastic T-shirt bags as described in claim 1, wherein at least one pressure point disposed below the slotted tab comprises a horizontal series of pressure points.

3. The stack of plastic T-shirt bags as described in claim 1 wherein said at least two vertically aligned pressure points disposed below each handle orifice comprises a series of pressure points.

4. The stack of plastic T-shirt bags as described in claim 1 wherein the pressure points are domed into the tab, the handles and the other areas of the bag walls.

5. The stack of plastic T-shirt type bags as described in claim 1 wherein the centrally disposed slotted tabs of the stack are welded together by having had inserted through them and withdrawn a hot pin to form an orfice which pin has melded together the areas of the two slotted tabs of the stack immediately surrounding the orifice so formed by the insertion and withdrawal of the hot pin, thereby to maintain the tabs of the stack in register for placement of their slots on the mounting element of the rack.

* * * * *